US009774128B2

(12) United States Patent
Ito et al.

(10) Patent No.: US 9,774,128 B2
(45) Date of Patent: Sep. 26, 2017

(54) CONNECTOR

(71) Applicant: Molex, LLC, Lisle, IL (US)

(72) Inventors: Naotoshi Ito, Yamato (JP); Kazushige Asakawa, Yamato (JP); Koji Chikano, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/270,100

(22) Filed: Sep. 20, 2016

(65) Prior Publication Data

US 2017/0149167 A1 May 25, 2017

(30) Foreign Application Priority Data

Nov. 20, 2015 (JP) ..... 2015-227535

(51) Int. Cl.
*H01R 13/52* (2006.01)
*H01R 13/506* (2006.01)
*H01R 31/08* (2006.01)

(52) U.S. Cl.
CPC ..... *H01R 13/5202* (2013.01); *H01R 13/5227* (2013.01); *H01R 13/506* (2013.01); *H01R 31/08* (2013.01); *H01R 2201/26* (2013.01)

(58) Field of Classification Search
CPC ..... H01R 13/5227; H01R 13/523
USPC ..... 439/205, 206
See application file for complete search history.

(56) References Cited

U.S. PATENT DOCUMENTS 4,963,099 A * 10/1990 Sato ..... H01R 9/2466 439/205
5,769,648 A * 6/1998 Hayashi ..... H01R 13/5227 439/206
5,860,822 A * 1/1999 Nishide ..... H01R 13/5227 439/206
5,941,719 A * 8/1999 Hayakawa ..... H01R 9/2466 439/206
6,113,407 A * 9/2000 Martin ..... H01R 13/521 439/205
6,319,057 B2 * 11/2001 Sekido ..... H01H 85/2045 439/190
6,787,698 B2 * 9/2004 Higuchi ..... H02G 3/088 174/50

(Continued)

FOREIGN PATENT DOCUMENTS

JP 2014-232584 A 12/2014

*Primary Examiner* — Gary Paumen
(74) *Attorney, Agent, or Firm* — James A. O'Malley

(57) ABSTRACT

A connector is provided which has terminals able to contact the opposing terminals connected to the terminal ends of electrical wires, and a housing accommodating the mounted terminals. The housing has a terminal accommodating recessed portion in the bottom end portion of the housing. The terminal accommodating recessed portion receives the inserted opposing terminals, and a head portion for sealing the upper end of the terminal accommodating recessed portion. The head portion includes a ceiling panel portion and side panel portions. Each side panel portion includes a water discharging hole communicating with the interior of the terminal accommodating recessed portion and outside of the housing, and a waterproofing rib formed around the water discharging hole and protruding from the outer surface of the side panel portion.

15 Claims, 15 Drawing Sheets

(56) References Cited

U.S. PATENT DOCUMENTS

| | | | | |
|---|---|---|---|---|
| 7,156,677 | B2 * | 1/2007 | Yamane | H01H 85/2045 439/206 |
| 7,201,592 | B2 * | 4/2007 | Hata | H02G 3/0691 439/206 |
| 8,075,325 | B1 * | 12/2011 | Kao | H01R 13/5213 438/141 |
| 8,257,101 | B2 * | 9/2012 | Ichio | H01R 13/4367 439/206 |
| 2005/0003698 | A1 * | 1/2005 | Hata | H02G 3/0691 439/470 |
| 2012/0258617 | A1 * | 10/2012 | Osawa | H01R 13/5227 439/205 |
| 2012/0295460 | A1 * | 11/2012 | Ichio | H01R 13/5208 439/205 |
| 2015/0343914 | A1 * | 12/2015 | Osawa | B60L 11/1818 439/205 |

* cited by examiner

CONNECTOR

RELATED APPLICATIONS

This application claims priority to Japanese Application No. 2015-227535, filed Nov. 20, 2015, which is incorporated herein by reference in its entirety.

TECHNICAL FIELD

The present disclosure relates to a connector.

BACKGROUND ART

When a connector is used in an outdoor environment, waterproofing countermeasures are required to prevent direct exposure to rainwater. However, these waterproofing countermeasures increase the complexity of the structure of the connector and the size of the connector. Separate components such as a waterproof case and waterproof seal are required, and these increase costs.

Instead of these waterproofing countermeasures, connectors have been proposed which are able to readily discharge any water that has entered to the outside, thereby reducing the complexity of the structure, the size of the connector, and costs. These connectors reduce corrosion of terminals to the extent that it no longer is a practical problem. (See, for example, Patent Document 1.)

FIG. 15 is a perspective view of a connector of the prior art.

In this drawing, 811 is the connector housing, which has a plurality of terminal accommodating holes 816 and a slit-like metal fitting accommodating recessed portion 817 extending in the transverse direction of the housing 811. A joint terminal metal fitting 851 is inserted into the front of the housing 811. The joint terminal metal fitting 851 has a base portion 853 extending in the transverse direction of the housing 811 and a plurality of terminal portions 852 protruding from the base portion 853. When the base portion 853 is accommodated in the metal fitting accommodating recessed portion 817, each terminal portion 852 is exposed inside the corresponding terminal accommodating hole 816.

The terminal accommodating holes 816 pass through the housing 811 in the longitudinal direction, and electrical wire terminals connected to the leading ends of electrical wires not shown in the drawing are inserted on the side opposite the inserted joint terminal metal fitting 851. The electrical wire terminals of the electrical wires inserted into each terminal accommodating hole 816 come into contact with the corresponding terminal portion 852, and an electrical connection is established with a plurality of electrical wires.

A flange-like annular rib 844 is formed on the outer periphery of the housing 811 near the front end, and a cap 841 is connected to the annular rib 844 via a flexible connecting piece 845. After the base portion 853 of the joint terminal metal fitting 851 has been accommodated inside the metal fitting accommodating recessed portion 817, the cap 841 is displaced so as to cover the front surface of the housing 811. In this way, the front end of the housing 811 is accommodated inside the interior space 842 of the cap 841 while the outer periphery is covered. As a result, water does not enter the terminal accommodating holes 816 from the front of the housing 811 even when exposed to rainwater.

Because the rear end of the housing 811 is not covered, water can enter the terminal accommodating holes 816 from the rear via the gaps between the electrical wires. However, a through-hole 843 connecting the interior space 842 to the outside is formed on the bottom side of the cap 841 when covering the front end portion of the housing 811. Therefore, any water entering the terminal accommodating holes 816 does not pool inside the terminal accommodating holes 816 but is discharged to the outside via the through-hole 843. As a result, the electrical wires and the joint terminal metal fitting 851 do not become corroded.

Patent Document 1: Laid-Open Patent Publication No. 2014-232584

SUMMARY

However, when a connector of the prior art is used without securing the housing 811 using a securing tool and the orientation of the connector changes so that the through-hole 843 faces upwards, water may enter the terminal accommodating holes 816 via the through-hole 843 and the electrical wires and joint terminal metal fitting 851 may become corroded.

The present disclosure solves the problem associated with the prior art by providing a connector which makes it difficult for water to enter the terminal accommodating recessed portion even when the orientation of the connector changes, which can readily discharge to the outside any water that does enter the terminal accommodating recessed portion, which is easy to manufacture, which has a simple, inexpensive configuration, which is easy to handle, and which is highly reliable.

The present disclosure is a connector comprising terminals able to contact the opposing terminals connected to the terminal ends of electrical wires, and a housing accommodating the mounted terminals, the housing having a terminal accommodating recessed portion in the bottom end portion of the housing, the terminal accommodating recessed portion receiving the inserted opposing terminals, and a head portion for sealing the upper end of the terminal accommodating recessed portion, the head portion including a ceiling panel portion and side panel portions, each side panel portion including a water discharging hole communicating with the interior of the terminal accommodating recessed portion and outside of the housing, and a waterproofing rib formed around the water discharging hole and protruding from the outer surface of the side panel portion.

In another connector of the present disclosure, each waterproofing rib is formed so as to surround at least half of a water discharging hole.

In another connector of the present disclosure, each waterproofing rib is formed so as to continuously surround an entire water discharging hole.

In another connector of the present disclosure, each waterproofing rib includes a first rib extending along the ceiling panel portion and a side panel portion and formed so as to surround at least half of a water discharging hole and a second rib protruding from the outer surface of a side panel portion by an amount smaller than that of the first rib.

In another connector of the present disclosure, the ceiling panel portion is a substantially rectangular member, each side panel portion is a member extending from one of the four side ends of the ceiling panel portion, and a water discharging hole is formed at each of the four corners of the head portion.

In another connector of the present disclosure, each terminal has a single common portion, a plurality of connecting arm portions extending from the common portion, and a contact portion connected to the leading end of each connecting arm portion, the contact portion contacting an opposing terminal.

Another connector of the present disclosure further comprises a pair of retainers for keeping the opposing terminals from becoming detached, the pair of retainers including a retainer main body covering at least some of the side surfaces positioned below the head portion of the housing, each retainer main body including a pair of side panel portions opposing each other, a male abutting portion formed on the front end edge of one side panel portion extending in the vertical direction and a female abutting portion formed on the front end edge of another side panel portion extending in the vertical direction, the male abutting portion and the female abutting portion on one retainer main body mating unevenly with the male abutting portion and the female abutting portion on the other retainer main body when the pair of retainers is attached to the housing.

The present disclosure provides a connector which makes it difficult for water to enter the terminal accommodating recessed portion even when the orientation of the connector changes, and which can readily discharge to the outside any water that does enter the terminal accommodating recessed portion. The connector is also easy to manufacture, has a simple, inexpensive configuration, is easy to handle, and is highly reliable.

BRIEF DESCRIPTION OF THE DRAWINGS

FIGS. 1A and 1B are a pair of perspective views of a connector with a mounted retainer in an embodiment of the present disclosure, in which FIG. 1A is a view of the connector from above and FIG. 1B is a view of the connector from below.

FIGS. 2A and 2B are a pair of side views of a connector with a mounted retainer in an embodiment of the present disclosure, in which FIG. 2A is a view from the narrower side and FIG. 2B is a view from the wider side.

FIGS. 3A and 3B are a pair of plan views of a connector with a mounted retainer in an embodiment of the present disclosure, in which FIG. 3A is a top view and FIG. 3B is a bottom view.

FIGS. 4A and 4B are a pair of perspective views of a connector with a removed retainer in an embodiment of the present disclosure, in which FIG. 4A is a view of the connector from above and FIG. 4B is a view of the connector from below.

FIGS. 5A and 5B are a pair of side views of a connector with a removed retainer in an embodiment of the present disclosure, in which FIG. 5A is a view from the narrower side and FIG. 5B is a view from the wider side.

FIGS. 6A and 6B are a pair of plan views of a connector with a removed retainer in an embodiment of the present disclosure, in which FIG. 6A is a top view and FIG. 6B is a bottom view.

FIGS. 7A and 7B are first and second perspective views of a retainer in an embodiment of the present disclosure, in which FIG. 7A and FIG. 7B are views from opposing directions.

FIGS. 8A and 8B are third and fourth perspective views of a retainer in an embodiment of the present disclosure, in which FIG. 8A and FIG. 8B are views from opposing directions.

FIGS. 9A and 9B are a pair of plan views of a retainer in an embodiment of the present disclosure, in which FIG. 9A is a top view and FIG. 9B is a bottom view.

FIGS. 10A and 10B are a pair of cross-sectional views of a housing in an embodiment of the present disclosure, in which FIG. 10A shows the housing when terminals have not been mounted and FIG. 10B shows the housing when terminals have been mounted.

FIGS. 12A and 12B are a pair of cross-sectional views of a first housing in an embodiment of the present disclosure showing the flow of water, in which FIG. 12A is a right-side up view and FIG. 12B is an upside down view.

FIGS. 13A and 13B are a pair of cross-sectional views of a second housing in an embodiment of the present disclosure showing the flow of water, in which FIG. 13A is a right-side up view and FIG. 13B is an upside down view.

FIGS. 14A and 14B are a pair of side views of a connector in an embodiment of the present disclosure showing the flow of water, in which FIG. 14A is an inclined view and FIG. 14B is an inverted inclined view.

DETAILED DESCRIPTION OF THE PREFERRED EMBODIMENTS

Figure 1B:
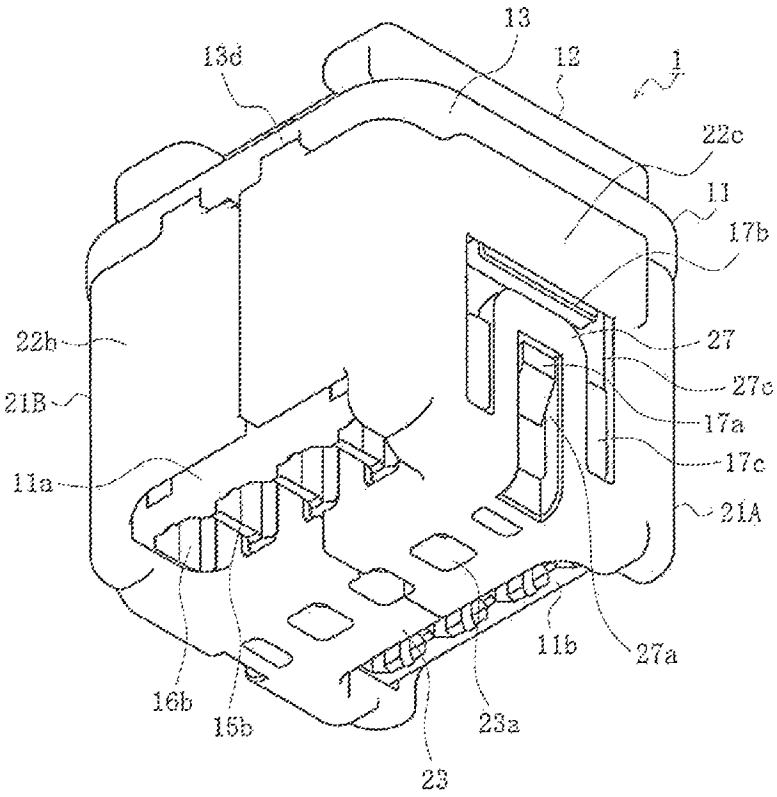
Figure 1A:
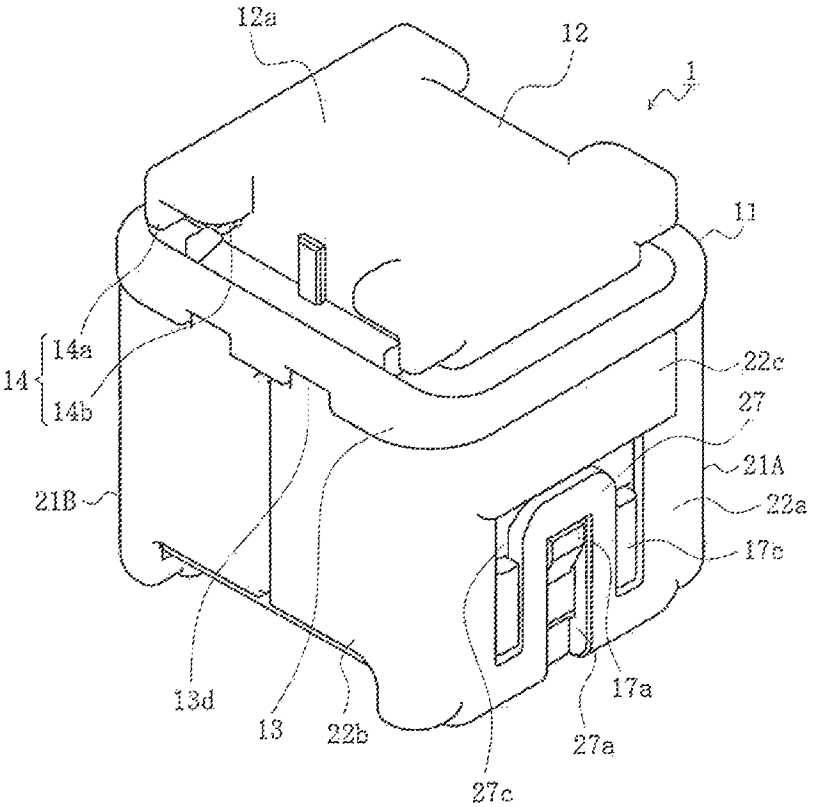

The following is detailed explanation of an embodiment with reference to the drawings.

In these drawings, 1 denotes the connector in the present embodiment. The ends of a plurality of electrical wires 91 described below are connected to this connector.

This connector 1 may be used in various types of equipment and devices such as those in home electronics and automobiles. In the following explanation, however, it is used in equipment and devices installed outdoors such as in the outdoor unit of an air conditioner or in a hot tub installed outdoors. In other words, the connector is installed inside the equipment or device in a location exposed directly to rainwater despite a housing, case, or cover. The connector 1 does not have to be secured inside the equipment or device using a securing component and may change orientation.

In the present embodiment, the expressions indicating direction, such as upper, lower, left, right, front and rear, which are used to explain the configuration and operation of each portion of the connector 1 are relative and not absolute. They depend on the orientation of the connector 1 and its constituent components shown in the drawings. When the orientation of the connector 1 or its constituent components changes, the interpretation changes in response to the change in orientation.

The connector 1 includes a housing 11 with a substantially rectangular profile formed integrally from an insulating material such as a synthetic resin, terminals 51 made of a conductive metal mounted in the housing 11 so as to be able to contact opposing terminals 61 connected to the ends of the electrical wires 91, and a retainer 21 serving as an opposing terminal holding member which is formed integrally from an insulating material such as a synthetic resin and which keeps the electrical wires 91 and the opposing terminals 61 from becoming detached from the housing 11.

The housing 11 includes a housing main body 11*a* with a substantially rectangular profile, a flange portion 13 formed so as to protrude from the outer periphery of the upper end of the housing main body 11*a*, and a head portion 12 formed so as to cover the upper end surface of the housing main body 11*a*. The housing 11 is equipped with a terminal accommodating recessed portion 16 extending inside the housing 11 in the vertical direction. The upper end is sealed by the head portion 12 and the lower end is open to the lower end portion 11*b* of the housing main body 11*a*.

Figure 6B:
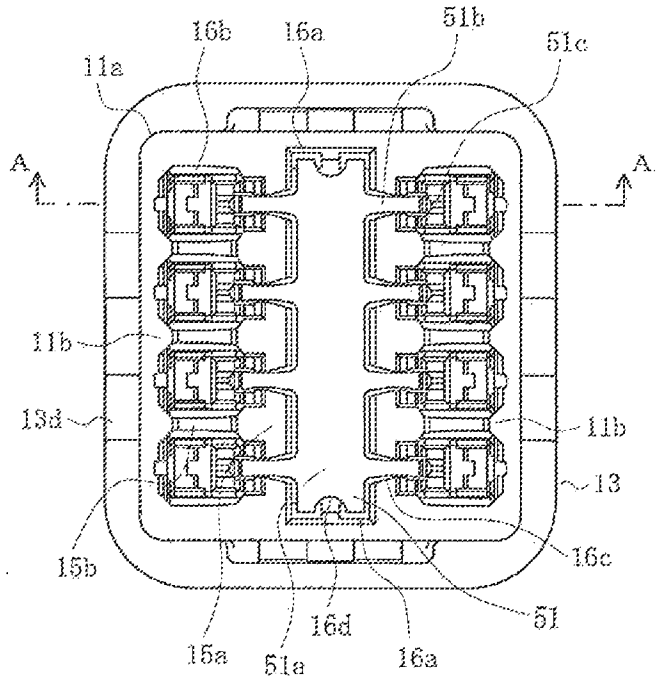
Figure 6A:
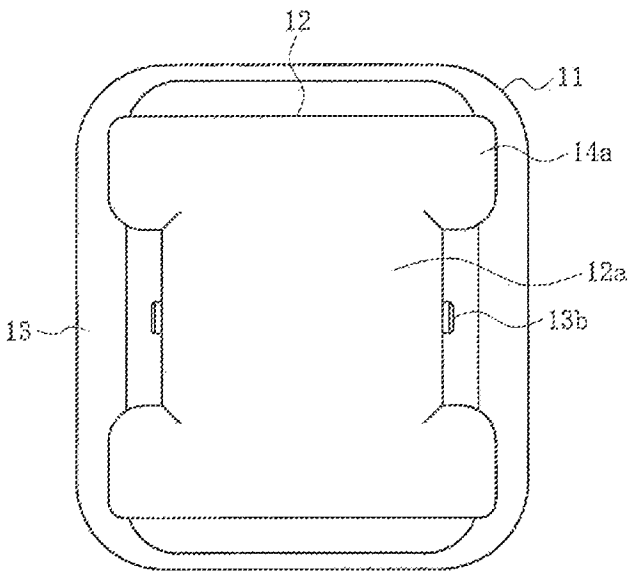
Figure 7B:
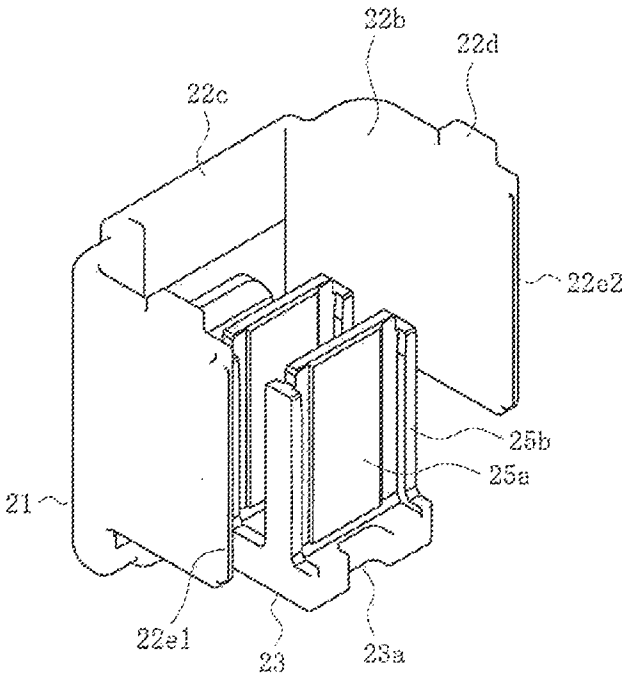
Figure 7A:
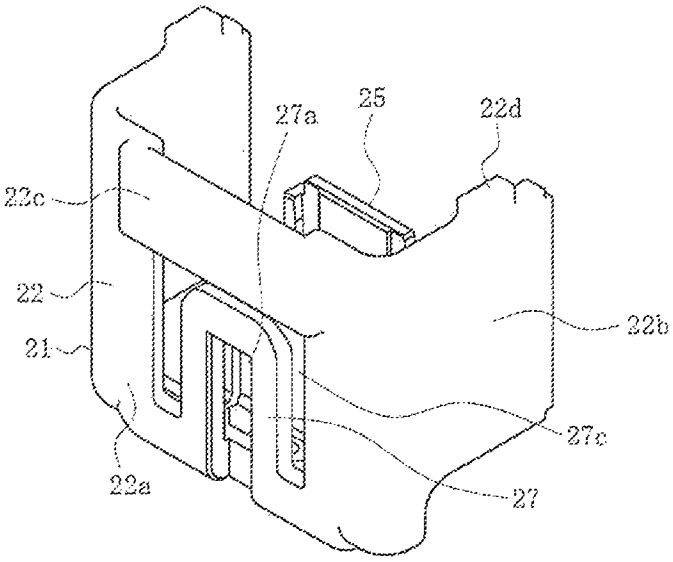
Figure 8B:
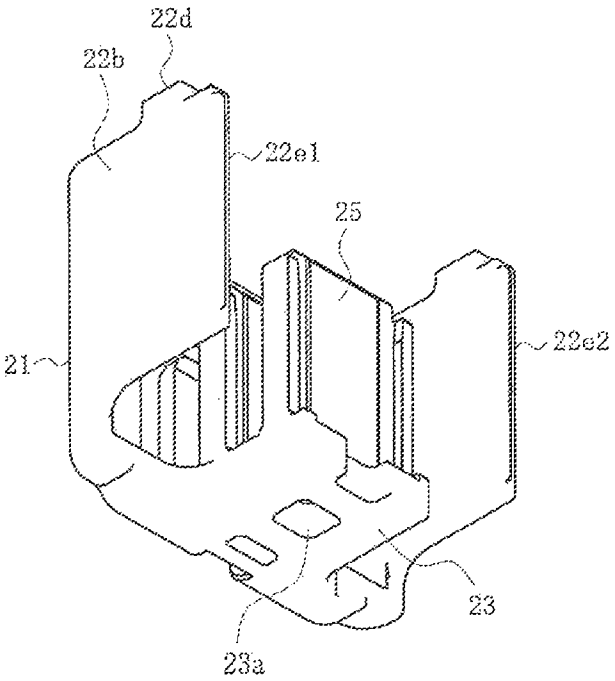
Figure 8A:
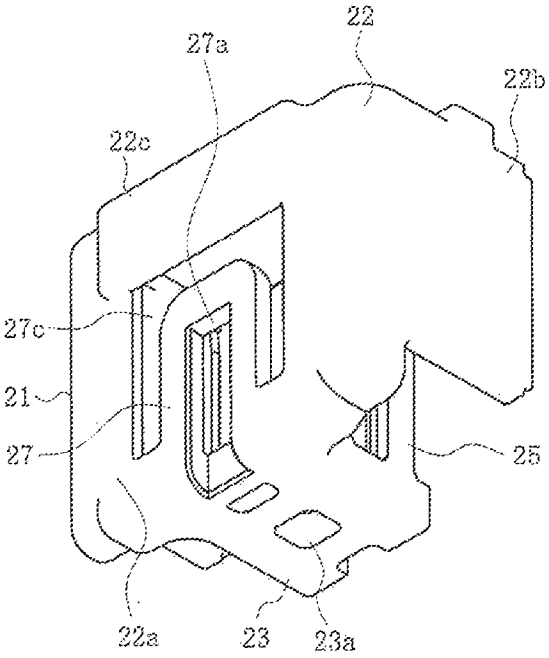
Figure 9A:
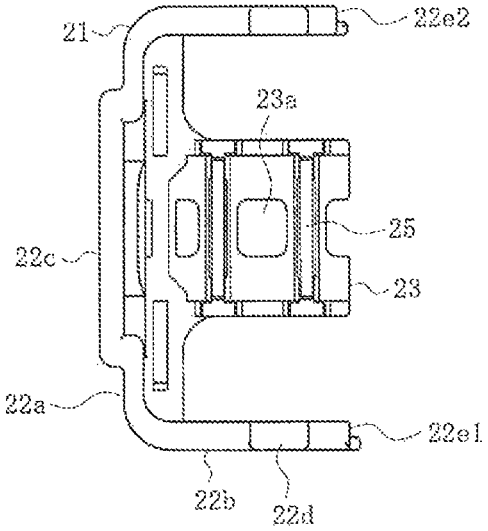
Figure 9B:
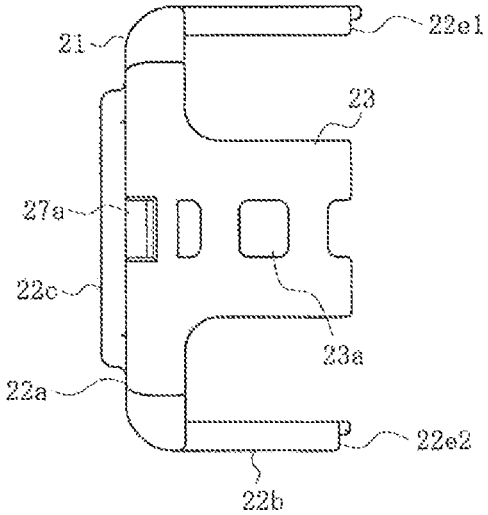

The terminal accommodating recessed portion 16 is divided by a partitioning wall 15 extending in the vertical direction into a central recessed portion 16*a*, opposing terminal accommodating portions 16*b* arranged side by side on both sides of the central recessed portion 16*a*, and a communicating recessed portion 16*c* communicating with the central recessed portion 16*a* and each opposing terminal accommodating portion 16*b*. The central recessed portion 16*a*, as shown in FIG. 6B, is a slender, rectangular, slit-like recessed portion whose opening in the lower end portion 11*b* extends parallel to the wider side surface of the housing 11. This accommodates the common portion 51*a* of the terminals 51. The common portion 51*a* is accommodated inside the central recessed portion 16*a* so that the upper surface abuts the recessed portion ceiling 16*d* positioned in the innermost portion (uppermost portion) of the terminal accommodating recessed portion 16.

In the example shown in the drawings, four opposing terminal accommodating portions 16*b* are arranged side by side on both sides of the central recessed portion 16*a*. However, the number of opposing terminal accommodating portions 16*b* can be changed to reflect the number of electrical wires 91. The pitch of the opposing terminal accommodating portions 16*b* can also be changed. A single contact portion 51*c* on a terminal 51 is accommodated inside each opposing terminal accommodating portion 16*b*.

Figure 10B:
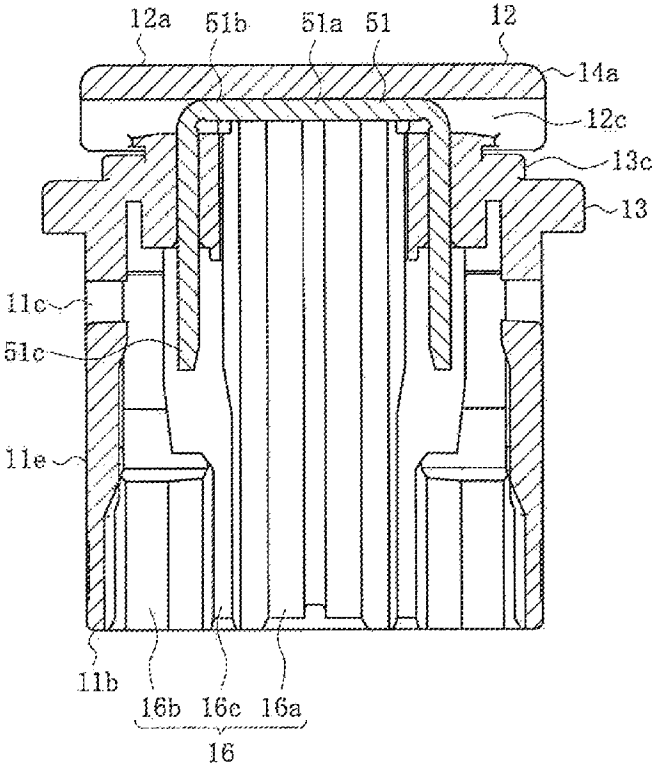

In the present embodiment, each terminal 51 has a single, flat common portion 51*a* with a rectangular profile, a plurality of slender connecting arm portions 51*b* extending outward in the transverse direction of the common portion 51*a* from the left and right sides of the common portion 51*a*, and a slender contact portion 51*c* connected to the leading end of each connecting arm portion 51*b*. As shown in FIG. 10B, the section where a contact portion 51*c* is connected to a connecting arm portion 51*b* is bent at a substantially right angle. As a result, the leading end of each contact portion 51*c* is accommodated inside each opposing terminal accommodating portion 16*b* while facing the lower end portion 11*b* of the housing main body 11*a*. Note that a contact portion 51*c* does not have to be accommodated inside every opposing terminal accommodating portion 16*b*. In other words, if necessary, the number of contact portions 51*c* can be smaller than the number of available opposing terminal accommodating portions 16*b*.

The partitioning wall 15 has a pair of large partitioning walls 15*a* extending parallel to the wider side surface of the housing 11 to demarcate the left and right sides of the central recessed portion 16*a*, and small partitioning walls 15*b* extending towards the wider side surface of the housing 11 from each large partitioning wall 15*a* in a direction orthogonal to the large partitioning walls 15*a* to demarcate the boundaries between adjacent opposing terminal accommodating portions 16*b*. Note that a plurality of communicating recessed portions 16*c* in the form of slit-like grooves are formed in the large partitioning walls 15*a* so that the central recessed portion 16*a* communicates with each of the opposing terminal accommodating portions 16*b*. Each connecting arm portion 51*b* of the terminals 51 is arranged in the innermost portion of the terminal accommodating recessed portion 16 so as to pass through the communicating recessed portion 16*c*.

A lance portion 11*e* is formed in the wider side surface of the housing main body 11*a* in a position corresponding to each opposing terminal accommodating portion 16*b*. Each lance portion 11*e* is connected to the housing main body 11*a* at the bottom end. The upper end remains free to form a cantilevered plate-like member. The upper end engages the terminal lance portion 61*c* of an opposing terminal 61 housed inside the opposing terminal accommodating portion 16*b* as described below. Note that a lance opening 11*c* is formed above each lance portion 11*e* in the wider side wall of the housing main body 11*a*. This opening communicates with the interior of an opposing terminal accommodating portion 16*b* and the exterior of the housing main body portion 11*a* so as to be able to receive a terminal lance portion 61*c*.

A lock protruding portion 17*a* engaging a lock recessed portion 27*a* on a retainer 21, a lock side protruding portion 17*c* engaging a lock side recessed portion 27*c* on a retainer 21, and an upper protruding portion 17*b* positioned above the lock protruding portion 17*a* and the lock side protruding portion 17*c* so as to be able to support a bulging portion 22*c* of a retainer 21 are formed on the narrower side surface of the housing main body 11*a*. A stopper recessed portion 13*d* for engaging a stopper protruding portion 22*d* on a retainer 21 is formed on the bottom surface of the flange portion 13 above the narrow side surface on the housing main body 11*a*, The head portion 12 includes a flat, ceiling panel portion 12*a* with a rectangular profile, and flat side panel portions 12*b* extending downward from the four side ends of the ceiling panel portion 12*a*. An upper water discharging hole 12*c* is formed near the upper ends, that is, near both ends of the side panel portions 12*b* in the transverse direction positioned above the narrow side surfaces of the housing main body 11*a*. In the example shown in the drawings, the upper water discharging holes 12*c* communicate with the innermost portion of the opposing end accommodating portion 16*b* and the exterior of the housing 11 at the four corners of the head portion 12.

If necessary, the upper water discharging holes 12*c* may be formed in the side panel portions 12*b* above the narrow side surfaces of the housing main body 11*a*, may be formed near the center of the side panel portions 12*b* in the transverse direction, or may be formed near the bottom end of the side panel portions 12*b*. There may also be five or more holes or three or fewer holes. As shown in the drawings, they are preferably formed at the four corners of the head portion 12, near both ends of the side panel portions 12*b* in the transverse direction above the narrow side surfaces of the housing main body 11*a* and near the upper end.

Figure 2B:
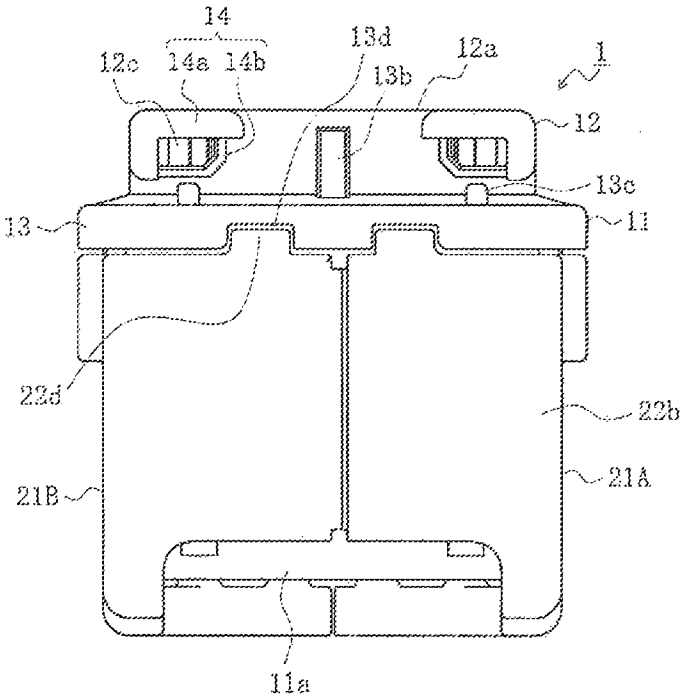
Figure 2A:
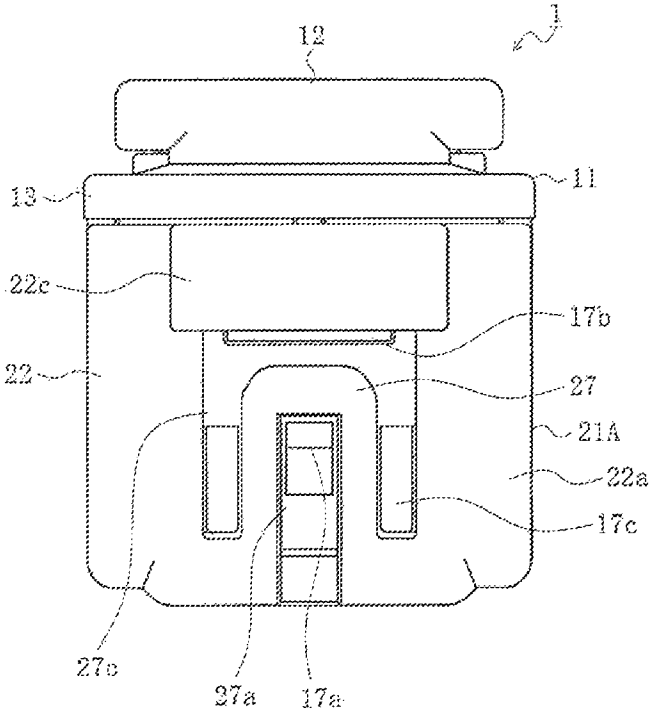
Figure 3B:
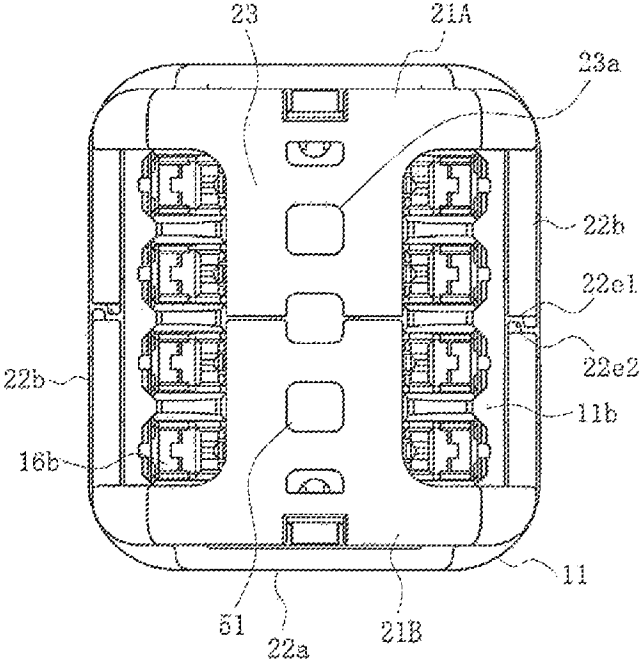
Figure 3A:
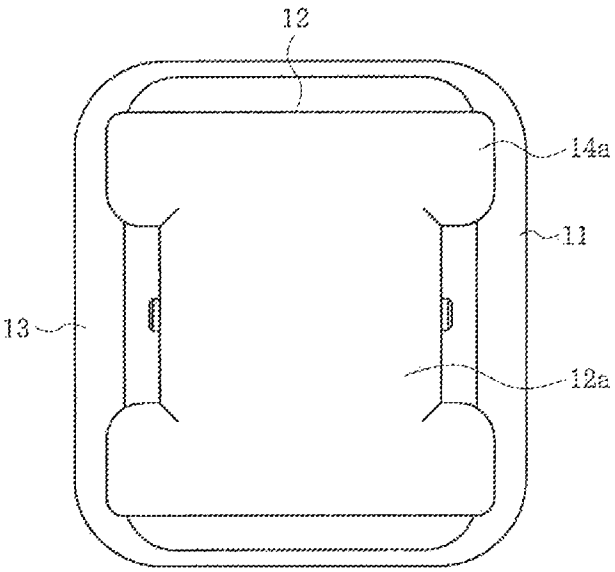
Figure 4B:
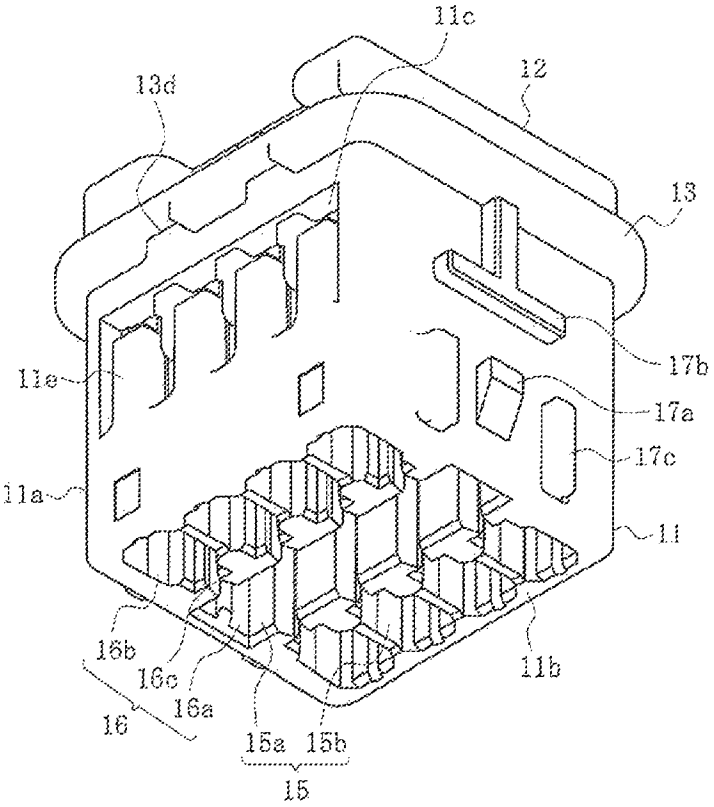
Figure 4A:
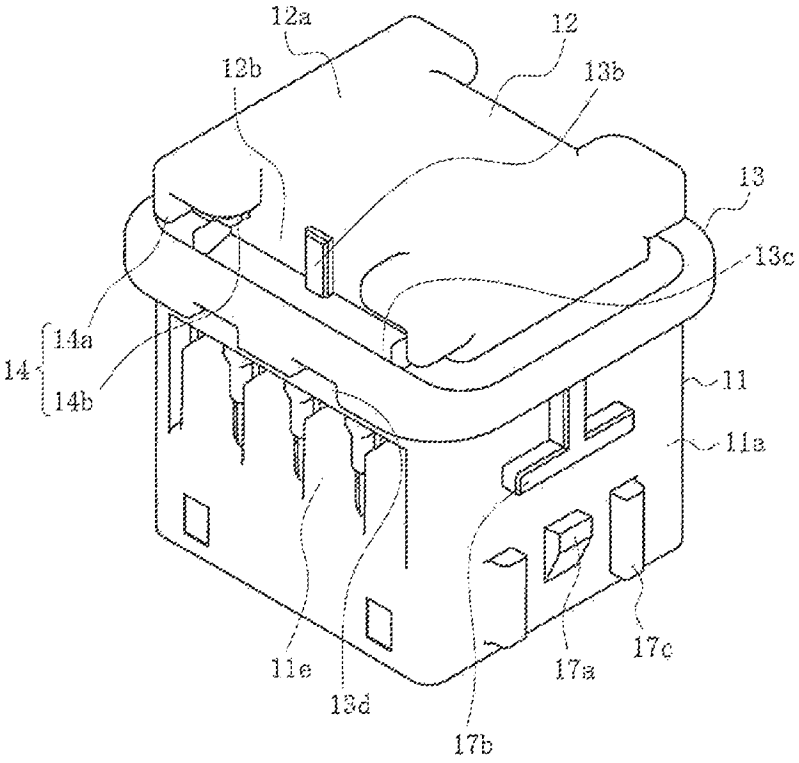
Figure 5B:
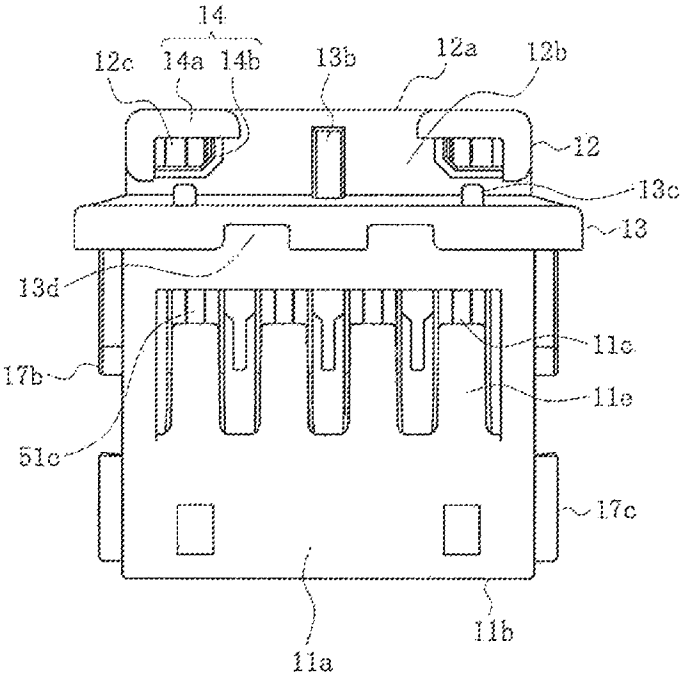
Figure 5A:
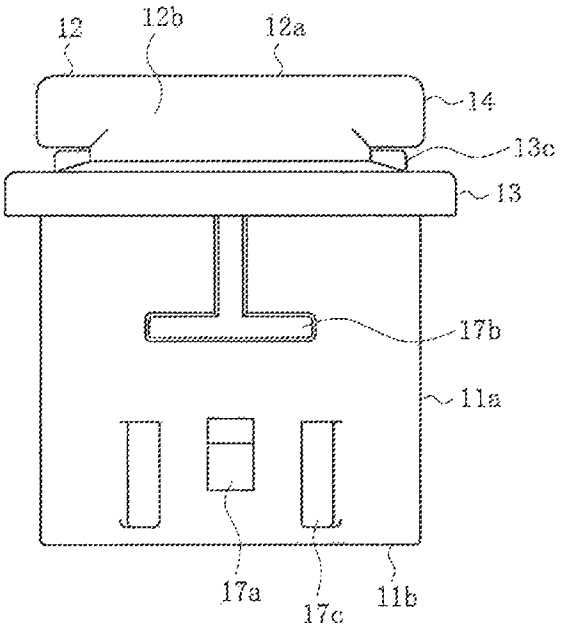

As shown in FIG. 2B and FIG. 5B, the openings in the upper water discharging holes 12*c* have a rectangular profile. However, the present disclosure is not limited to this profile. The openings may have any profile. For the sake of convenience, the openings in the upper water discharging holes 12*c* have a substantially rectangular profile in the following explanation and as shown in FIG. 2B and FIG. 5B.

Eaves-like ribs 14 which protrude to the outside are formed as waterproofing ribs on the periphery of the openings in the upper water discharging holes 12*c* on the outer surface of the side panel portions 12*b*. These ribs may surround only a portion of the openings in the upper water discharging holes 12*c* but preferably surround more than half of the openings in the upper water discharging holes 12*c*. Even more preferably, these ribs continuously surround the openings in the upper water discharging holes 12*c* without interruption.

In the example shown in the drawings, the ribs 14 are composed of large ribs 14*a* or primary ribs on two sides of the rectangular openings and small ribs 14*b* or secondary ribs on the other two sides of the rectangular openings. The large ribs 14*a* are members which extend over the side panel portions 12*b* and ceiling panel portion 12*a* above the narrower side surfaces of the housing main body 11*a* and, as shown in FIG. 2B and FIG. 5B, are thick, wedge-shaped, eaves-like members protruding significantly to the outside. The small ribs 14*b*, as shown in FIG. 2B and FIG. 5B, are thin, wedge-shaped, eaves-like members protruding to the outside less than the large ribs 14*a*.

Note that there does not have to be a difference in thickness or amount of protrusion between the large ribs 14*a* and the small ribs 14*b*. Also, the ribs 14 do not have to continuously surround the openings in the upper water discharging holes 12*c*. There may be some gaps or interruptions. For example, some portions of the smaller ribs 14*b* can be left out or the small ribs 14*b* can be omitted entirely.

In the example shown in the drawings, a first guide rib 13*b* protruding outward, extending in the vertical direction, and connected to the upper surface of the flange portion 13 on the lower end is formed in the center of the side panel portions 12*b* in the transverse direction above the wider side surface of the housing main body 11*a*. Also, a second guide rib 13*c* protruding upward is formed below the upper water discharging holes 12*c* on the upper surface of the flange portion 13.

In the present embodiment, the connector 1 has a pair of retainers 21. In FIG. 1A through FIG. 3B, the pair of retainers 21 are differentiated by assigning the reference numbers 21A and 21B to them. However, retainer 21A and retainer 21B have the same structure. When retainer 21A and retainer 21B do not have to be differentiated from one another, they are referred to collectively in the explanation as the retainers 21.

The retainers 21 have a retainer main body 22 with a shape resembling an angular tube cut in half, a lower panel portion 23 protruding forward from the lower end of the retainer main body 22, an engaging arm 25 protruding upward from the lower panel portion 23, and a lock panel portion 27 formed in the retainer main body 22.

The retainer main body 22 has a base panel portion 22*a* extending in the vertical direction, a pair of side panel portions 22*b* facing each other and extending forward from the left and right side edges of the base panel portion 22*a*, a bulging portion 22*c* formed near the upper edge of the base panel portion 22*a*, a stopper protruding portion 22*d* formed on the upper edge of each side panel portion 22*b*, a male abutting portion 22*e*1 formed on the front end edge of one side panel portion 22*b* extending in the vertical direction, and a female abutting portion 22*e*2 formed on the front end edge of another side panel portion 22*b* extending in the vertical direction. When retainer 21A and retainer 21B are attached to the housing 11, the male abutting portion 22*e*1 and the female abutting portion 22*e*2 mate with each other unevenly. This seals the front edges of the side panel portions 22*b* of retainer 21A and the front edges of the side panel portions 22*b* of retainer 21B.

The lock panel portion 27 is a cantilevered U-shaped panel member connected on the lower end to the base panel portion 22*a* of the retainer main body 22 and leaving the upper end free. A lock recessed portion 27*a* is formed in the central portion and entering the lock panel portion 27 in the thickness direction. The periphery is demarcated by a lock side recessed portion 27*c* formed in the base panel portion 22*a* in the thickness direction.

When the retainers 21 are attached to the housing 11, the upper ends of the engaging arms 25 contact or approach an opposing terminal 61 housed inside an opposing terminal accommodating portion 16*b*, and this keeps the opposing terminals 61 from becoming detached from the housing 11. Therefore, a plurality of engaging arms 25 corresponding to the number of opposing terminal accommodating portions 16*b* are formed. In the example shown in the drawings, two are formed on the lower panel portion 23 of each retainer 21. Note that lower water discharging holes 23*a* are formed as water discharging holes in the lower panel portions 23 in positions not occupied by the engaging arms 25 and pass through the lower panel portions 23 in the thickness direction.

Each engaging arm 25 includes a base panel portion 25*a* extending parallel to the base panel portion 22*a* of the retainer main body 22, and an ear portion 25*b* connected on both the left and right ends of the base panel portion 25*a* and formed at a thickness greater than that of the base panel portion 25*a*. When the retainers 21 are attached to the housing 11, the base panel portion 25*a* traverses the central recessed portion 16*a* and enters the left and right communicating recessed portions 16*c* while the ear portion 25*b* enters the left and right opposing terminal accommodating portions 16*b*.

As shown in FIG. 1A through FIG. 3B, the pair of retainers, namely, retainer 21A and retainer 21B, are attached to the housing 11 so as to cover the periphery of the housing main body 11*a*. Note that retainer 21A and retainer 21B are attached when the connector 1 is to be used, that is, when the electrical wires 91 are connected and the ends of the electrical wires 91 connected to the opposing terminals 61 are housed inside the opposing terminal accommodating portions 16*b*. For explanatory purposes, FIG. 1A through FIG. 3B do not show the ends of electrical wires 91 connected to the opposing terminals 61 housed inside the opposing terminal accommodating portions 16*b*.

When pair of retainers, that is, retainer 21A and retainer 21B, are attached to the housing 11, the lock recessed portion 27*a* engages the lock protruding portion 17*a*, and the lock panel portion 27 is engaged. In this way, retainer 21A and retainer 21B are locked in the housing 11 and are kept from detaching from the housing 11. The stopper protruding portion 22*d* engages the stopper recessed portion 13*d*, the lock recessed portion 27*a* engages the lock protruding portion 17*a*, and the male abutting portion 22*e*1 and the female abutting portion 22*e*2 are mated in an uneven manner. In this way, the side surfaces below the flange portion 13 of the housing 11 are covered by retainer 21A and retainer 21B. Also, the lower end portions 11*b* of the housing main body 11*a* are covered by lower panel portions 23 in the section corresponding to the central recessed portion 16*a* of the terminal accommodating recessed portion 16.

The following is an explanation of the water penetration preventing function and the water discharge promoting function of a connector 1 with this configuration.

As shown in FIG. 10B, the terminals 51 are housed inside the terminal accommodating recessed portion 16 so that the upper surface of the common portion 51*a* comes into contact with the recessed portion ceiling 16*d* positioned on the innermost (uppermost) portion of the terminal accommodating recessed portion 16. Also, the contact portions 51*c* are bent at a substantially right angle and connected to the connecting arm portion 51*b*, and the terminals are housed inside each opposing terminal accommodating portion 16*b* with the leading end facing the lower end portion 11*b* of the housing main body 11*a*.

Figure 11:
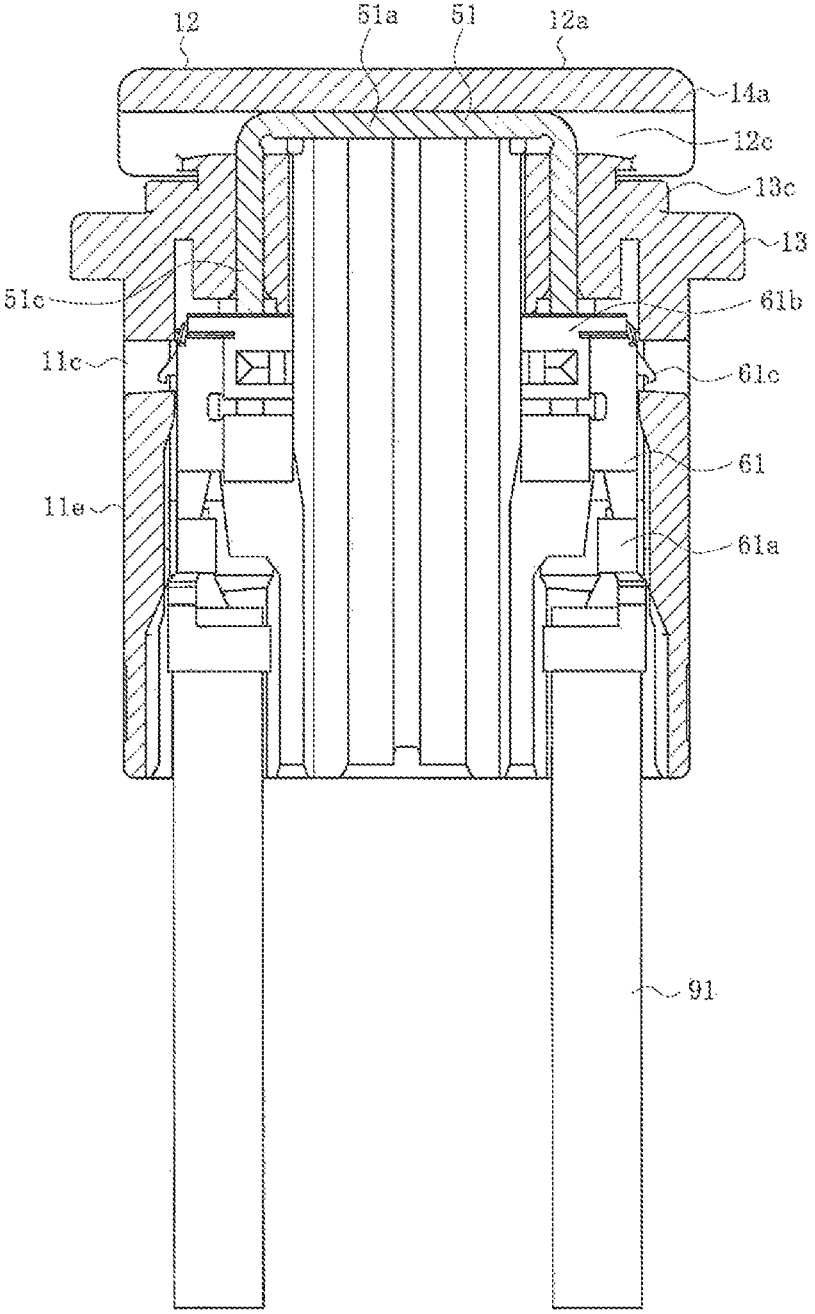
FIG. 11 is a cross-sectional view of a housing with electrical wires connected in an embodiment of the present disclosure.

When the ends of the electrical wires 91 are inserted from below the housing main body 11*a* into the opposing terminal accommodating portion 16*b*, as shown in FIG. 11, the opposing terminals 61 connected to the ends of the electrical wires 91 contact the contact portions 51*c* and establish an electrical connection with the terminals 51.

The opposing terminals 61 are members integrally formed by stamping and bending conductive metal sheets, and include an electrical wire connecting portion 61*a*, an opposing contact portion 61*b*, and a terminal lance portion 61*c*. The electrical wire connecting portion 61*a* is secured to the electrical wire 91 and establishes an electrical connection with the conductive core wire inside the electrical wire 91. It is secured to the electrical wire 91 and the core wire inside by crimping. The opposing contact portion 61*b* is a tube-shaped portion extending upward from the leading end of the electrical wire connecting portion 61*a*. It is brought into contact with the contact portion 51*c* by interposing the contact portion 51*c* inside the tube. The terminal lance portion 61*c* is a cutout piece formed so that the leading end extends downward at an angle. It enters the lance opening 11*c* in the housing 11 and engages the upper end of the lance portion 11*e*.

Figure 10A:
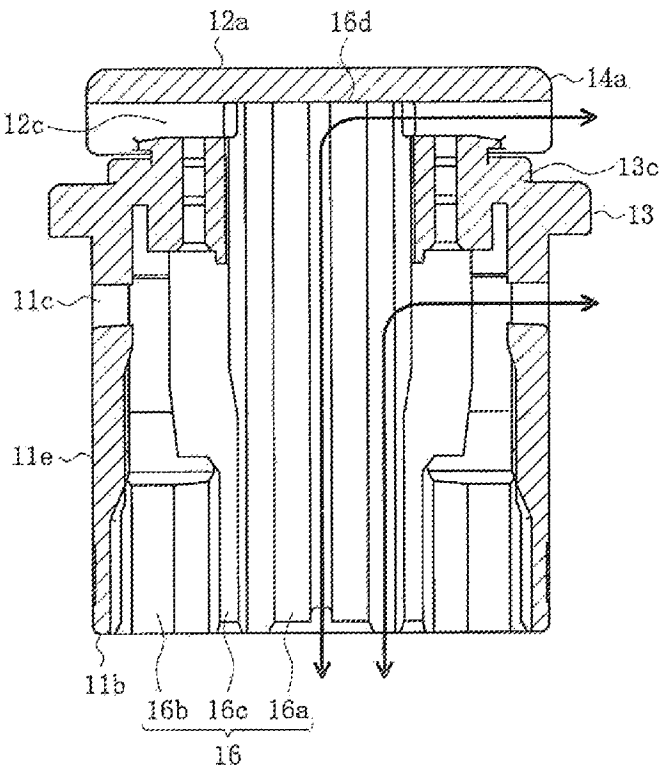

The connector 1 in the present embodiment makes it less likely that water will enter the terminal accommodating recessed portion 16, and makes it easy to discharge any water that may enter the terminal accommodating recessed portion 16. For example, in FIG. 10A, the solid arrows show how water that has entered the terminal accommodating recessed portion 16 is discharged via the opening in the terminal accommodating recessed portion 16 in the lower end portion 11*b* and via the lance opening 11*c* and the upper water discharging hole 12*c*. For the sake of convenience in explanation, the mounted terminals 51 are not shown in FIG. 10A.

Figure 12B:
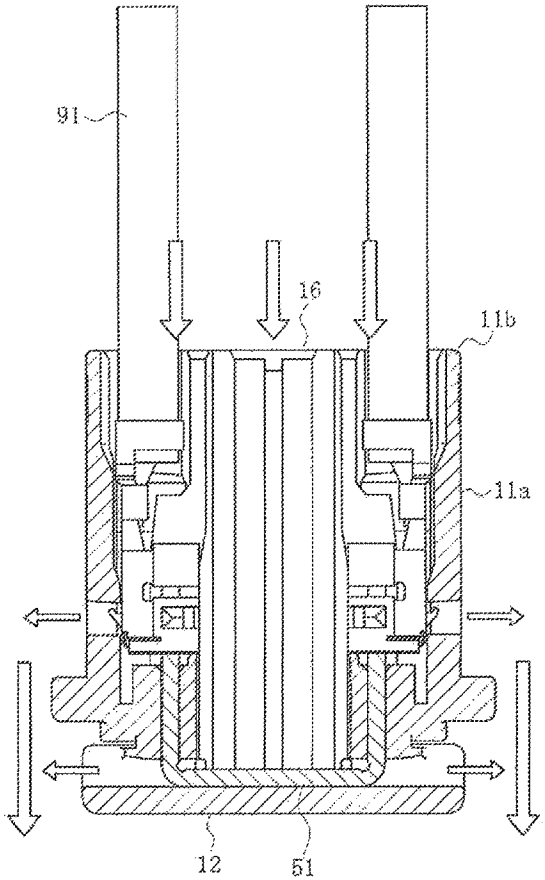
Figure 12A:
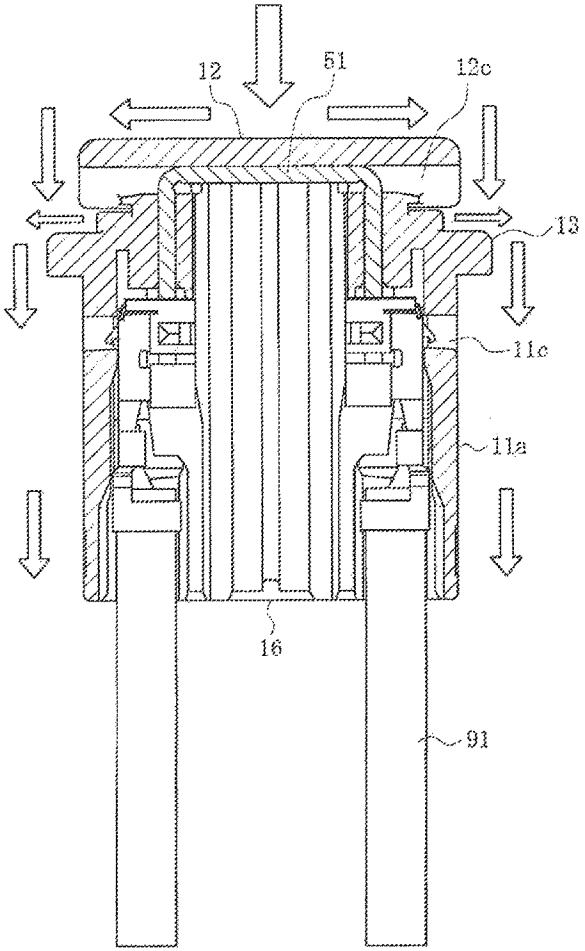

When the connector 1 is in the intended orientation, that is, in the upright orientation, as indicated by the solid-line arrows in FIG. 12A, water from the outside such as raindrops flow over the outside of the housing 11 and water is less likely to enter the terminal accommodating recessed portion 16.

For the sake of convenience in explanation, the water from the outside is depicted as falling in the gravitational direction, but it may fly towards the connector from a horizontal direction due to strong horizontal winds.

When the connector 1 is in an upside down orientation, as indicated by the solid-line arrows in FIG. 12B, water from the outside such as raindrops enter the housing 11 from the opening in the lower end portion 11*b*, but does not pool inside the terminal accommodating recessed portion 16 because it is discharged to the outside via a lance opening 11*c* and an upper water discharging hole 12*c*.

Figure 13B:
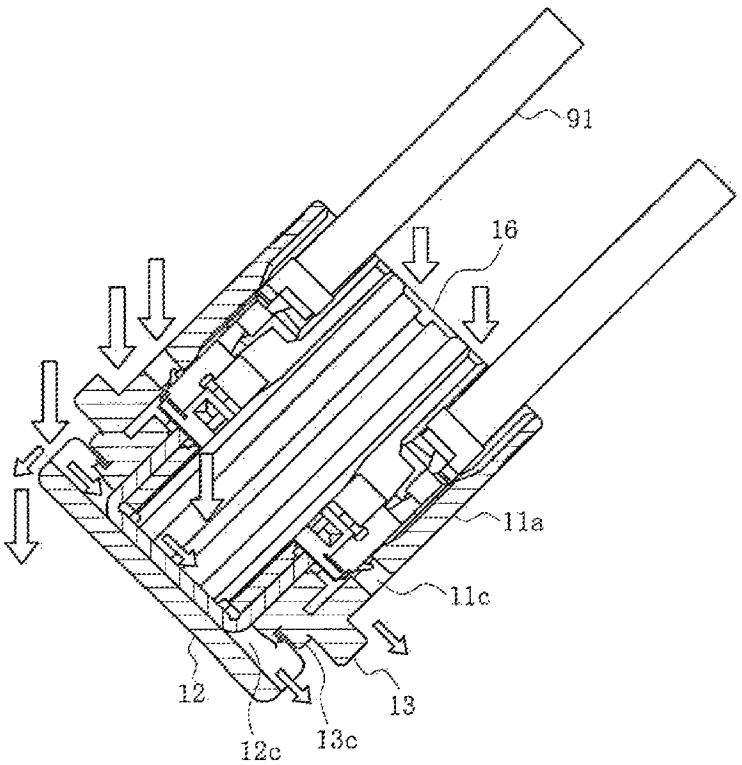
Figure 13A:
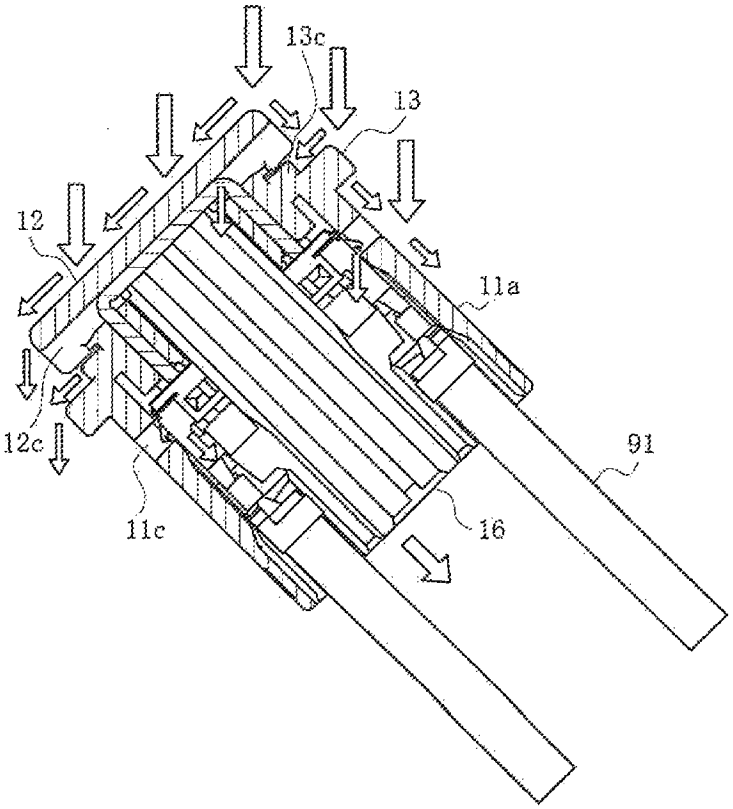

When the connector 1 is inclined at an angle, as indicated by the solid-line arrows in FIG. 13A, water from the outside such as raindrops enter the housing from a lance opening 11*c* and an upper water discharging hole 12*c* which are inclined at an angle. However, water does not pool inside the terminal accommodating recessed portion 16 because it is discharged to the outside via a lance opening 11*c*, an upper water discharging hole 12*c* and the opening in the terminal accommodating recessed portion 16 in the lower end portion 11*b* which are all inclined on an angle.

When the connector 1 is inclined upside down at an angle, as indicated by the solid-line arrows in FIG. 13B, water from the outside such as raindrops enter the housing from a lance opening 11*c*, an upper water discharging hole 12*c*, and the opening in the terminal accommodating recessed portion 16 in the lower end portion 11*b* which are inclined at an angle. However, water does not pool inside the terminal accommodating recessed portion 16 because it is discharged to the outside via a lance opening 11*c* and an upper water discharging hole 12*c* which are all inclined on an angle.

When the pair of retainers, that is, retainer 21A and retainer 21B, are attached to the housing 11, the lance openings 11*c* are covered by the side panel portions 22*b*, and the opening corresponding to the central recessed portion 16*a* of the terminal accommodating recessed portion 16 in the lower end portion 11*b* is covered by the lower panel portion 23. This makes it even less likely that water will enter the terminal accommodating recessed portion 16. In this situation, an upper water discharging hole 12*c* is open and a lower water discharging hole 23*a* is formed in the lower panel portion 23. Also, the openings in the lower end portion 11*b* corresponding to the opposing terminal accommodating portions 16*b* of the terminal accommodating recessed portion 16 are not covered. As a result, water entering the terminal accommodating recessed portion 16 can be smoothly discharged to the outside.

Figure 14B:
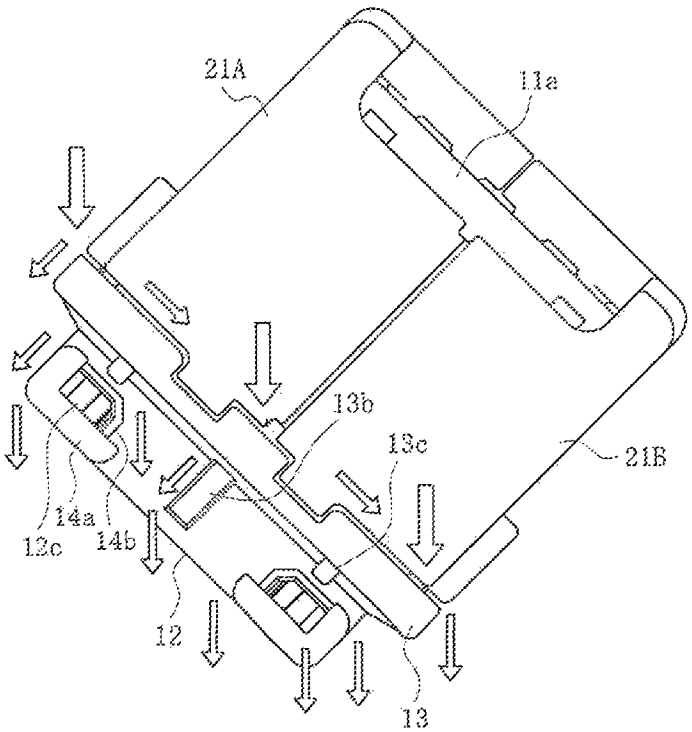
Figure 14A:
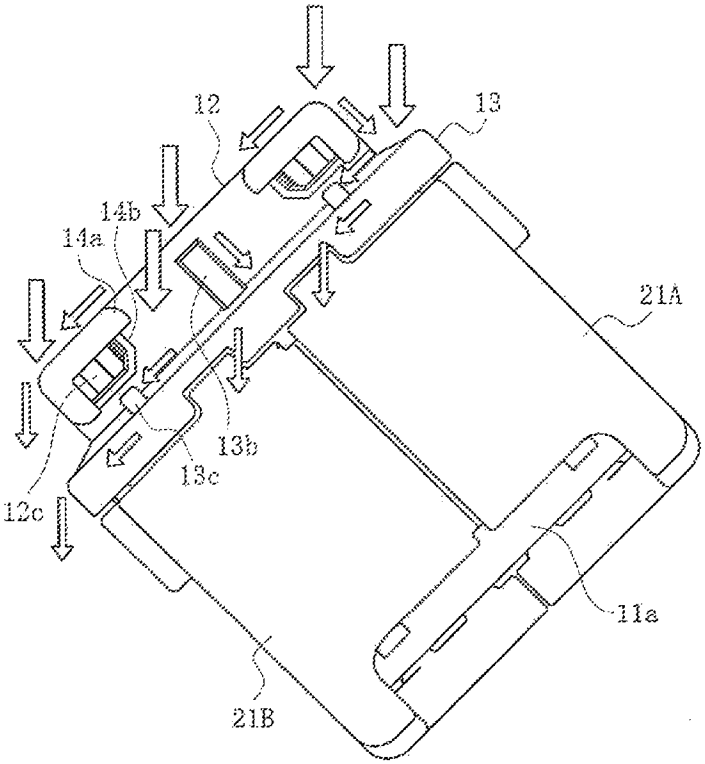
Figure 15:
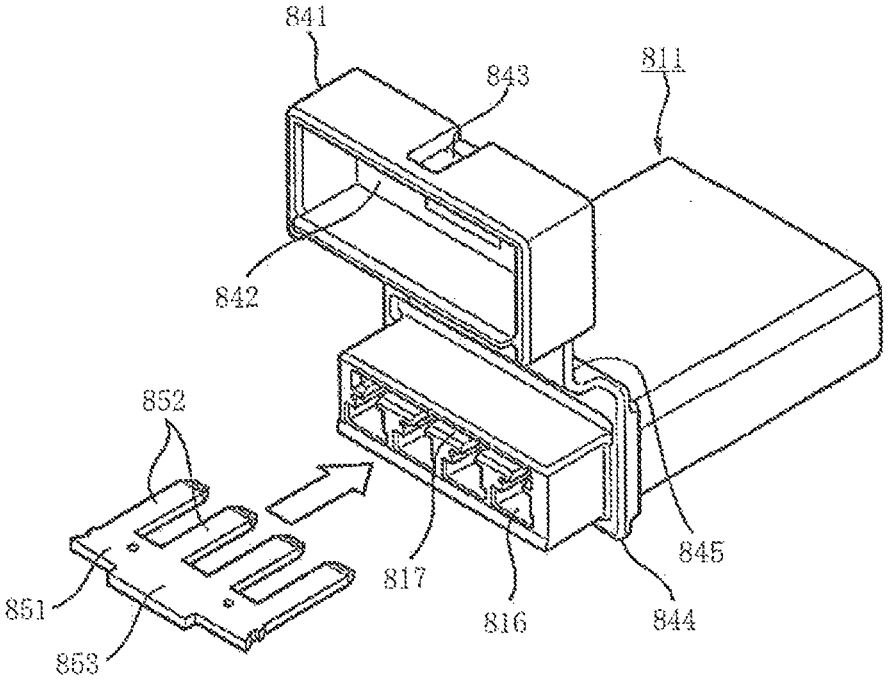
FIG. 15 Prior Art
FIG. 15 is a perspective view of a connector of the prior art.

Because a rib 14 is formed around the openings in the upper discharging holes 12*c* on the outer surface, the water on the inside is discharged smoothly to the outside, and water on the outside is kept from entering the connector. In FIGS. 14A and 14B, the flow of water around the upper water discharging holes 12*c* on the outer surface is indicated by thick-line arrows.

When the connector 1 is inclined at an angle, as shown in FIG. 14A, water from the outside such as raindrops is kept from entering the upper water discharging holes 12*c* by the eaves-like large ribs 14*a* and small ribs 14*b*. Water flowing over the outer surface of the housing 11 is kept from reaching the upper water discharging holes 12*c* by the first guide ribs 13*b* and the second guide ribs 13*c*, and the water is guided so as to fall from the upper surface of the flange portion 13.

When the connector 1 is upside down and inclined at an angle, as shown in FIG. 14B, water from the outside such as raindrops is kept from entering the upper water discharging holes 12*c* by the small ribs 14*b*. Water flowing over the outer surface of the housing 11 is kept from reaching the upper water discharging holes 12*c* and is guided so as to fall from the surface primarily by the first guide ribs 13*b* and the flange portions 13.

In the present embodiment, as explained above, the connector 1 comprises terminals 51 able to contact the opposing terminals 61 connected to the terminal ends of electrical wires 91, and a housing 11 accommodating the mounted terminals 51. The housing 11 has a terminal accommodating recessed portion 16 in the bottom end portion 11*b* of the housing 11, the terminal accommodating recessed portion receiving the inserted opposing terminals 61, and a head portion 12 for sealing the upper end of the terminal accommodating recessed portion 16. The head portion 12 includes a ceiling panel portion 12*a* and side panel portions 12*b*, each side panel portion 12*b* including an upper water discharging hole 12*c* communicating with the interior of the terminal accommodating recessed portion 16 and outside of the housing 11, and a waterproofing rib 14 formed around the upper water discharging hole 12*c* and protruding from the outer surface of the side panel portion 12*b*.

In this way, it is difficult for water to enter the terminal accommodating recessed portion 16 even when the orientation of the connector 1 changes, and any water that does enter the terminal accommodating recessed portion 16 can be readily discharged to the outside of the connector 1. Therefore, a certain degree of waterproofing can be maintained without using special components such as a waterproof case or waterproof seal. As a result, the configuration of the connector 1 remains simple, small, easy to handle, and reliable, and costs can be reduced.

Also, each waterproofing rib 14 is preferably formed so as to surround at least half of an upper water discharging hole 12*c*. More preferably, each waterproofing rib 14 is formed so as to continuously surround an entire upper water discharging hole 12*c*. In this way, water from the outside can be kept from entering the terminal accommodating recessed portion 16 via the upper water discharging holes 12*c* to a certain degree.

In addition, each waterproofing rib 14 includes a large rib 14*a* extending along the ceiling panel portion 12*a* and a side panel portion 12*b* and formed so as to surround at least half of an upper water discharging hole 12*c*, and a small rib 14*b* protruding from the outer surface of a side panel portion 12*b* by an amount smaller than that of the large rib 14*a*. In this way, when the connector 1 is not in the upright orientation, water from the outside can be effectively kept from entering the terminal accommodating recessed portion 16 via the upper water discharging holes 12*c*.

Also, the ceiling panel portion 12*a* is a substantially rectangular member, each side panel portion 12*b* is a member extending from one of the four side ends of the ceiling panel portion 12*a*, and an upper water discharging hole 12*c* is formed at each of the four corners of the head portion 12. Because an upper water discharging hole 12*c* is formed at each of the four corners of the head portion 12, it remains difficult for water to enter the terminal accommodating recessed portion 16 even when the orientation of the connector 1 changes, and any water that does enter the terminal accommodating recessed portion 16 can be readily discharged to the outside of the connector 1.

Each terminal 51 has a single common portion 51*a*, a plurality of connecting arm portions 51*b* extending from the common portion 51*a*, and a contact portion 51*c* connected to the leading end of each connecting arm portion 51*b*. Here, the contact portion 51*c* also contacts an opposing terminal 61. In this way, an electrical connection is established with each electrical wire 91.

Also, the connector 1 includes a pair of retainers 21 for keeping the opposing terminals 61 from becoming detached, the pair of retainers 21 including a retainer main body 22 covering at least some of the side surfaces positioned below the head portion 12 of the housing 11. Each retainer main body 22 includes a pair of side panel portions 22*b* opposing each other, a male abutting portion 22*e*1 formed on the front end edge of one side panel portion 22*b* extending in the vertical direction and a female abutting portion 22*e*2 formed on the front end edge of another side panel portion 22*b* extending in the vertical direction. The male abutting portion 22*e*1 and the female abutting portion 22*e*2 on one retainer main body 22 mates unevenly with the male abutting portion 22*e*1 and the female abutting portion 22*e*2 on the other retainer main body 22 when the pair of retainers 21 is attached to the housing 11. In this way, water from the outside is kept from entering the terminal accommodating recessed portion 16.

In the disclosure of the present specification, characteristics related to specific preferred embodiments were described. A person of ordinary skill in the art could naturally devise other embodiments, modifications, and variations with reference to the disclosure of the present specification without departing from the spirit and scope of the appended claims.

The disclosure can be applied to a connector.

The invention claimed is:

1. A connector comprising:

terminals which are configured to contact opposing terminals connected to terminal ends of electrical wires; and a housing accommodating the terminals, the housing having a terminal accommodating recessed portion and a head portion, the terminal accommodating recessed portion having first and second ends, the terminal accommodating recessed portion configured to receive the opposing terminals connected to terminal ends of electrical wires via the first end, the head portion configured to seal the second end of the terminal accommodating recessed portion, the head portion including a ceiling panel portion, a side panel portion and a waterproofing rib, the side panel portion including a water discharging hole communicating with an interior of the terminal accommodating recessed portion and an outside of the housing, the waterproofing rib being formed around the water discharging hole and protruding from an outer surface of the side panel portion, wherein the waterproofing rib includes a first rib portion that extends along the ceiling panel portion and the side panel portion and a second rib portion that extends along the side panel portion, wherein the second rib portion protrudes from the outer surface of the side panel portion by an amount smaller than does the first rib portion.

2. The connector according to claim 1, wherein the waterproofing rib is formed so as to surround at least half of the water discharging hole.

3. The connector according to claim 2, wherein the waterproofing rib is formed so as to continuously surround an entirety of the water discharging hole.

4. The connector according to claim 1, wherein the ceiling panel portion is a substantially rectangular member having four sides, wherein the head portion has four side panel portions and four waterproofing ribs, wherein each side panel portion extends from a respective one of the four sides of the ceiling panel portion, each side panel portion having a water discharging hole, each waterproofing rib being formed around a respective one of the water discharging holes.

5. The connector according to claim 1, wherein each terminal has a single common portion, a plurality of connecting arm portions extending from the common portion, and a contact portion connected to the leading end of each connecting arm portion, each contact portion configured to contact one of the opposing terminals connected to terminal ends of electrical wires.

6. The connector according to claim 1, wherein the second end of the terminal accommodating recessed portion is provided at a bottom end portion of the housing.

7. The connector according to claim 4, wherein the water discharging holes are provided at corners of the head portion.

8. A connector comprising:

terminals which are configured to contact opposing terminals connected to terminal ends of electrical wires;

a housing accommodating the terminals, the housing having a terminal accommodating recessed portion and a head portion, the terminal accommodating recessed portion having first and second ends, the terminal accommodating recessed portion configured to receive the opposing terminals connected to terminal ends of electrical wires via the first end, the head portion configured to seal the second end of the terminal accommodating recessed portion, the head portion including a ceiling panel portion, a side panel portion and a waterproofing rib, the side panel portion including a water discharging hole communicating with an interior of the terminal accommodating recessed portion and an outside of the housing, the waterproofing rib being formed around the water discharging hole and protruding from an outer surface of the side panel portion; and a pair of retainers for keeping the opposing terminals connected to terminal ends of electrical wires from becoming detached from the terminals, each retainer including a retainer main body covering at least some of the side panel portion, each retainer main body including a pair of side panel portions opposing each other, a male abutting portion formed on a front end edge, and extending in a vertical direction, of one side panel portion of the retainer main body and a female abutting portion formed on a front end edge, and extending in the vertical direction, of another side panel portion of the retainer main body, the male abutting portion and the female abutting portion on one retainer main body mating unevenly with the male abutting portion and the female abutting portion on the other retainer main body when the pair of retainers are attached to the housing.

9. The connector according to claim 8, wherein the waterproofing rib is formed so as to surround at least half of the water discharging hole.

10. The connector according to claim 9, wherein the waterproofing rib is formed so as to continuously surround an entirety of the water discharging hole.

11. The connector according to claim 8, wherein the waterproofing rib includes a first rib portion that extends along the ceiling panel portion and the side panel portion and a second rib portion that extends along the side panel portion, wherein the second rib portion protrudes from the outer surface of the side panel portion by an amount smaller than does the first rib portion.

12. The connector according to claim 8, wherein the ceiling panel portion is a substantially rectangular member having four sides, wherein the head portion has four side panel portions and four waterproofing ribs, wherein each side panel portion extends from a respective one of the four sides of the ceiling panel portion, each side panel portion having a water discharging hole, each waterproofing rib being formed around a respective one of the water discharging holes.

13. The connector according to claim 12, wherein the water discharging holes are provided at corners of the head portion.

14. The connector according to claim 8, wherein the second end of the terminal accommodating recessed portion is provided at a bottom end portion of the housing.

15. The connector according to claim 8, wherein each terminal has a single common portion, a plurality of connecting arm portions extending from the common portion, and a contact portion connected to the leading end of each connecting arm portion, each contact portion configured to contact one of the opposing terminals connected to terminal ends of electrical wires.

* * * * *